US012662922B2

(12) United States Patent
Jiang et al.

(10) Patent No.: US 12,662,922 B2
(45) Date of Patent: Jun. 23, 2026

(54) FRACTURING SYSTEM

(71) Applicant: YANTAI JEREH OILFIELD SERVICES GROUP CO., LTD., Yantai (CN)

(72) Inventors: Yibo Jiang, Yantai (CN); Feng Wang, Yantai (CN); Xiangxiang Ren, Yantai (CN)

(73) Assignee: Yantai Jereh Oilfield Services Group Co., Ltd., Yantai (CN)

( * ) Notice: Subject to any disclaimer, the term of this patent is extended or adjusted under 35 U.S.C. 154(b) by 0 days.

(21) Appl. No.: 19/174,670

(22) Filed: Apr. 9, 2025

(65) Prior Publication Data

US 2025/0283398 A1 Sep. 11, 2025

Related U.S. Application Data

(63) Continuation of application No. PCT/CN2022/124305, filed on Oct. 10, 2022.

(51) Int. Cl.
*E21B 43/26* (2006.01)

(52) U.S. Cl.
CPC ..... *E21B 43/26* (2013.01)

(58) Field of Classification Search
CPC ..... E21B 43/2607
See application file for complete search history.

(56) References Cited

U.S. PATENT DOCUMENTS 6,431,226 B1 * 8/2002 Koslowsky ..... B67D 7/0401 901/41
9,400,263 B2 * 7/2016 An ..... G01N 29/225
10,466,719 B2 * 11/2019 Kibler ..... G05D 3/125
(Continued)

FOREIGN PATENT DOCUMENTS

CN 202785384 U 3/2013
CN 203463092 U 3/2014
(Continued)

OTHER PUBLICATIONS

International Search Report mailed Jun. 26, 2023 for International Application No. PCT/CN2022/124305.
(Continued)

*Primary Examiner* — Kenneth L Thompson
(74) *Attorney, Agent, or Firm* — Crowell & Moring LLP

(57) ABSTRACT

This application provides a fracturing system includes: a fracturing device having a hydraulic end; a high/low-pressure manifold skid including a main pipeline extending along a first direction and a main pipeline support for bearing the main pipeline; a guide rail; an intelligent working apparatus including a main body mounted on the guide rail; and a main-body driving mechanism. The fracturing device is located on at least one side of the high/low-pressure manifold skid in a second direction perpendicular to the first direction. The main pipeline is connected to the hydraulic end of the fracturing device. The guide rail is located on the high/low-pressure manifold skid and extends along the first direction. The main-body driving mechanism is connected to the main body of the intelligent working apparatus and configured to drive the main body of the intelligent working apparatus to move at least along the guide rail.

20 Claims, 7 Drawing Sheets

(56) References Cited

U.S. PATENT DOCUMENTS

| | | | | |
|---|---|---|---|---|
| 11,536,407 | B2 * | 12/2022 | Riedel, Jr. | F16L 41/03 |
| 11,560,973 | B2 * | 1/2023 | Post | E21B 43/2607 |
| 11,781,410 | B2 * | 10/2023 | Post | E21B 43/2607 137/615 |
| 12,049,797 | B1 * | 7/2024 | Post | E21B 17/20 |
| 2018/0281207 | A1 | 10/2018 | Tanaka | |

FOREIGN PATENT DOCUMENTS

| | | | |
|---|---|---|---|
| CN | 112628607 | A | 4/2021 |
| CN | 214264388 | U | 9/2021 |
| CN | 113714766 | A | 11/2021 |
| CN | 215145963 | U | 12/2021 |
| CN | 114658406 | A | 6/2022 |

OTHER PUBLICATIONS

Written Opinion mailed Jun. 26, 2023 for International Application No. PCT/CN2022/124305.

* cited by examiner

FRACTURING SYSTEM

CROSS-REFERENCE TO RELATED APPLICATIONS

This application is a continuation of and claims the benefit of priority to PCT International Patent Application No. PCT/CN2022/124305, filed on Oct. 10, 2022, and entitled "FRACTURING SYSTEM", which is incorporated herein by reference in its entirety.

TECHNICAL FIELD

This application generally relates to a fracturing system and particularly to fracturing pumps.

BACKGROUND

A hydraulic end of a plunger pump is an important component of the plunger pump, which realizes suction of low-pressure liquid and discharge of high-pressure liquid by using an internal structure thereof. During an actual wellsite fracturing operation, high-pressure sand-carrying fluid may erode the hydraulic end and components such as a valve body and a valve seat therein. Therefore, the hydraulic end and other components need to be replaced regularly. At present, replacement of the hydraulic end is manually completed through multi-person collaboration, resulting in a long replacement cycle and high personal operation intensity. Moreover, limited device replacement space and a heavy replacement device easily cause safety accidents such as injuries to personnel.

In an actual wellsite operation, the plunger pump generally operates for a long time and at high intensity, and abnormalities such as device failures may be inevitable during the operation. Since an operating region of the plunger pump is a high-pressure dangerous region, the personnel cannot conduct real-time inspection on the device, and therefore cannot discover and repair the device failures immediately, which may affect the service life of the device and even cause operational accidents.

SUMMARY

Embodiments of the present disclosure provides a fracturing system. A fracturing system of an embodiment includes: a fracturing device, a high/low-pressure manifold skid, a guide rail, an intelligent working apparatus, and a main-body driving mechanism. The fracturing device has a hydraulic end. The high/low-pressure manifold skid includes a main pipeline extending along a first direction and a main pipeline support for bearing the main pipeline. The fracturing device is located on at least one side of the high/low-pressure manifold skid in a second direction perpendicular to the first direction. The main pipeline is connected to the hydraulic end of the fracturing device. The guide rail is located on the high/low-pressure manifold skid and extends along the first direction. The intelligent working apparatus includes a main body mounted on the guide rail. The main-body driving mechanism is connected to the main body of the intelligent working apparatus and configured to drive the main body of the intelligent working apparatus to move at least along the guide rail.

In an embodiment, the guide rail and the high/low-pressure manifold skid at least partially overlap in a third direction perpendicular to both the first direction and the second direction.

In an embodiment, the fracturing system includes a plurality of fracturing devices located on at least one side of the guide rail in the second direction and spaced apart from each other in the first direction; the main-body driving mechanism is configured to drive the intelligent working apparatus to move to a target position on the guide rail to perform an operation on a target apparatus at the target position; the target position includes a position directly facing each of the plurality of fracturing devices; and the target apparatus includes the each fracturing device.

In an embodiment, the main-body driving mechanism is further configured to drive the intelligent working apparatus to rotate on the guide rail; and a rotation angle of the rotation being in a range of 0 to 360°.

In an embodiment, the intelligent working apparatus further includes a first mechanical arm, a first driving mechanism, and a second driving mechanism, wherein the first mechanical arm includes a connecting end connected to the main body and a working end away from the main body; the working end is configured to be detachably connected to a working component including at least one of a rotating component, a pulling component, and a clamping component, and the operation performed includes at least one of a rotating operation, a pulling operation, and a clamping operation; the first driving mechanism is connected to the connecting end of the first mechanical arm and is configured to drive the first mechanical arm to move in a three-dimensional space; and the second driving mechanism is configured to drive the working component connected to the working end to operate.

In an embodiment, the fracturing system further includes a working component accommodating apparatus disposed along the guide rail, connected to a guide rail support, and configured to accommodate the working component on standby; and the intelligent working apparatus is configured to move on the guide rail to cause the working end of the first mechanical arm to reach the working component accommodating apparatus and connect with the working component.

In an embodiment, the fracturing system further includes a control system communicatively, respectively, connected to the main-body driving mechanism, the first driving mechanism, and the second driving mechanism, wherein the control system is configured to control the main-body driving mechanism to drive the intelligent working apparatus to move at least along the guide rail to the target position and drive the intelligent working apparatus to rotate, configured to control the first driving mechanism to drive the first mechanical arm to move to the hydraulic end, and configured to control the second driving mechanism to the working component connected to the working end to dismount or mount functional components of the hydraulic end.

In an embodiment, the fracturing system further includes a guide rail support extending along the first direction, connected to the main pipeline support, and located on a side of the main pipeline support away from the ground, wherein the guide rail is mounted on the guide rail support and located on a side of the main pipeline away from the ground.

In an embodiment, the fracturing system further includes a conductive cable housing apparatus and a conductive cable. The conductive cable housing apparatus is located on the guide rail; the guide rail has a first side facing away from the main pipeline and a second side facing the main pipeline in a third direction; the intelligent working apparatus is located on the first side of the guide rail; and the conductive cable housing apparatus is located on the second side of the guide rail. The conductive cable is located in the conductive cable housing apparatus and is electrically connected to the intelligent working apparatus.

In an embodiment, the fracturing system further includes a shock-absorbing structure, the shock-absorbing structure being disposed on the guide rail support and configured to reduce vibration caused to the guide rail during the operation of the fracturing device.

In an embodiment, the intelligent working apparatus includes: an image acquisition apparatus connected to the control system in a signal manner and configured to acquire image information of a surrounding environment during the movement of the intelligent working apparatus on the guide rail, acquire image information of the target apparatus during the operation on the target apparatus at the target position, and transmit the image information to the control system; and the control system is configured to determine the target position according to the image information of the surrounding environment and the image information of the target apparatus, and the target position includes a position of the target apparatus where a failure occurs.

In an embodiment, the intelligent working apparatus includes a positioning module, the positioning module being connected to the control system in a signal manner and configured to transmit position information of the intelligent working apparatus to the control system, and the control system is configured to determine, according to the position information, whether the target position is reached.

In an embodiment, the intelligent working apparatus is configured to move according to a patrol route;

the positioning module is configured to record route position information of the intelligent working apparatus in real time during the movement of the intelligent working apparatus and send the route position information to the control system, the control system is further configured to receive and record the route position information forming the patrol route, and the control system is further configured to control, according to the patrol route, the intelligent working apparatus to move based on the patrol route; or the control system includes position information in the patrol route and is configured to control, according to the position information in the patrol route, the intelligent working apparatus to move based on the patrol route, the positioning module is configured to acquire real-time route position information of the intelligent working apparatus during the movement according to the patrol route and send the real-time route position information to the control system, and the control system is further configured to determine whether the route position information is correct.

In an embodiment, the intelligent working apparatus includes an infrared sensor, the infrared sensor being configured to perform infrared sensing on the surrounding environment during the movement of the intelligent working apparatus and send an infrared sensing result to the control system; and the control system is configured to control a position of the intelligent working apparatus according to the infrared sensing result.

In an embodiment, the intelligent working apparatus includes a flame sensor, the flame sensor being configured to perform temperature sensing on the surrounding environment during the movement of the intelligent working apparatus and send a temperature sensing result to the control system, and the control system is configured to determine, according to the temperature sensing result, whether a flame is required.

In an embodiment, the fracturing system further includes a fracturing device positioning structure, the fracturing device positioning structure being detachably connected to the main pipeline support and at least partially protruding beyond the main pipeline support from the main pipeline support towards the fracturing device, wherein a position of the positioning structure on the main pipeline support along the first direction is adjustable.

In an embodiment, the fracturing device positioning structure has an adjustable portion and is configured to operate in one of an unfolded state and a folded state; in the unfolded state, the adjustable portion extends along the second direction and protrudes from the main pipeline support towards the fracturing device; and a length of the adjustable portion along the second direction is reduced to convert the high/low-pressure manifold skid into the folded state, and in the folded state, at least part of the fracturing device positioning structure is received so as not to protrude from the main pipeline support in the second direction.

In an embodiment, the fracturing device further includes a fracturing apparatus including the hydraulic end and a power end connected to the hydraulic end; a motor; and a reduction gearbox, wherein the motor is connected to the power end by using the reduction gearbox, the motor and the fracturing apparatus are located on a same side of the reduction gearbox, and the motor and the fracturing apparatus are arranged in a direction perpendicular to an extension direction of a motor shaft of the motor.

In an embodiment, the motor and the fracturing apparatus are located on the same side of the reduction gearbox in the first direction and are arranged along the second direction; the motor shaft of the motor extends along the first direction; and the fracturing system includes a plurality of fracturing devices located on at least one side of the main pipeline in the second direction and spaced apart from each other along the first direction.

In an embodiment, the hydraulic end has an inlet and an outlet, and the main pipeline includes a low-pressure main pipeline and a high-pressure main pipeline, both extending along the first direction and being arranged in the third direction; the low-pressure main pipeline is configured to provide low-pressure liquid for the hydraulic end; and the high-pressure main pipeline is configured to receive high-pressure liquid outputted by the hydraulic end; for each of the fracturing devices, in the second direction, the hydraulic end is located on a side of the power end close to the main pipeline; the fracturing system further includes a sub-pipeline corresponding to the each fracturing device and located between the guide rail and the main pipeline support.

In an embodiment, the sub-pipeline includes a low-pressure sub-pipeline and a high-pressure sub-pipeline. The low-pressure sub-pipeline is connected to the low-pressure main pipeline and the inlet of the hydraulic end of the corresponding fracturing device; the high-pressure sub-pipeline is connected to the high-pressure main pipeline and the outlet of the hydraulic end of the corresponding fracturing device; and at least one of the low-pressure sub-pipeline and the high-pressure sub-pipeline includes a telescopic pipeline structure including a telescopic pipeline and a flexible high-pressure hose, both extending along the second direction and being communicated with each other; a first end of the high-pressure hose is connected to the hydraulic end; a second end of the high-pressure hose is connected to the telescopic pipeline; and a length of the telescopic pipeline in the second direction is adjustable.

In an embodiment, in the second direction, the high-pressure hose is located on a side of the telescopic pipeline close to the hydraulic end of the fracturing device.

In an embodiment, the low-pressure sub-pipeline and/or the high-pressure sub-pipeline including the telescopic pipeline structure are/is a single pipeline.

BRIEF DESCRIPTION OF THE DRAWINGS

To illustrate the technical solutions of the embodiments of the present disclosure, the accompanying drawings of the embodiments will be briefly introduced below. The accompanying drawings in the following description only relate to some embodiments of the present disclosure, and are not intended to limit the present disclosure.

DESCRIPTIONS OF REFERENTIAL NUMERALS

Figure 1:
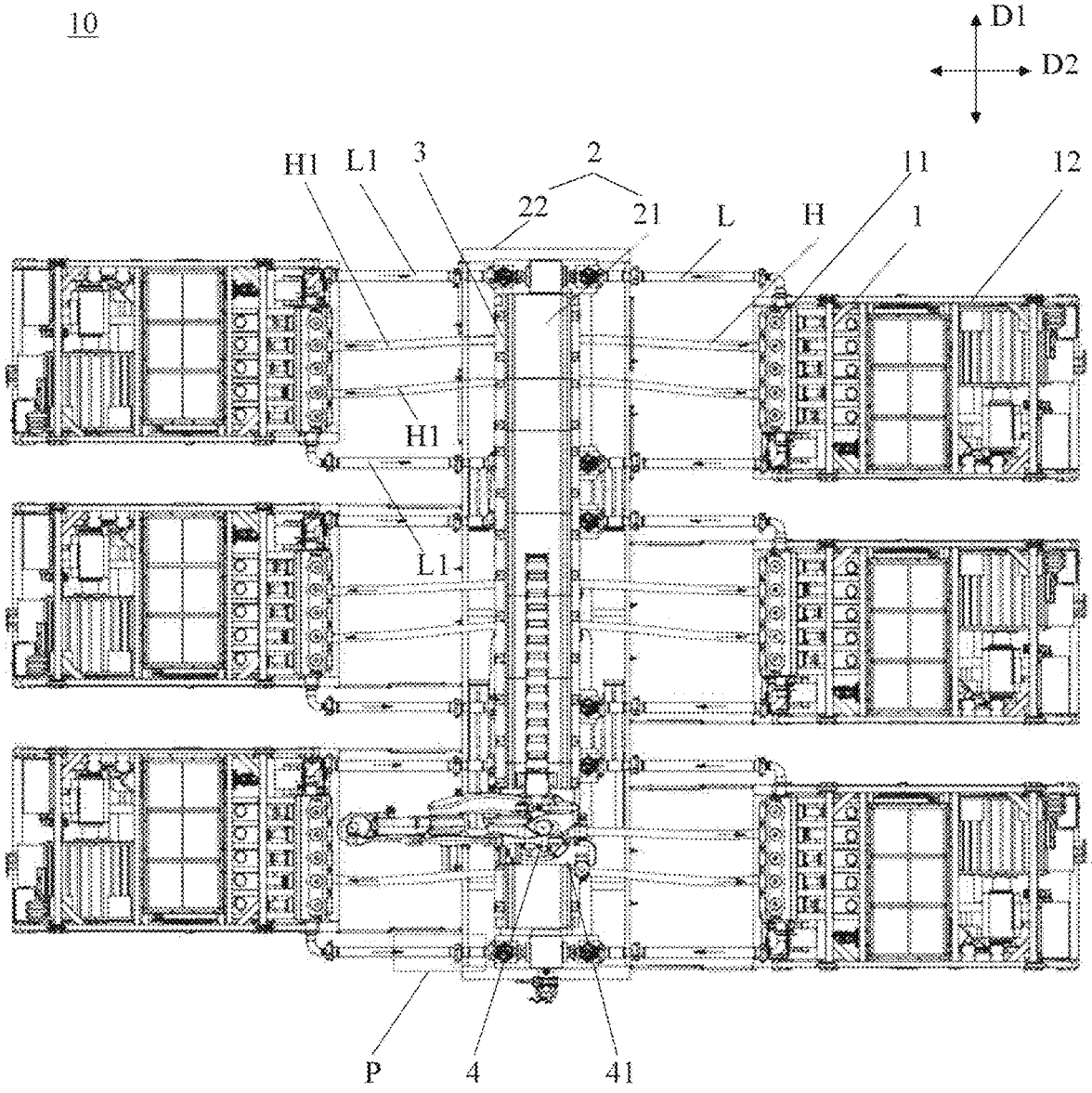
FIG. 1 is an example schematic plan view of a fracturing system according to an embodiment of the present disclosure.

10—fracturing system;
1—fracturing devices;
  11—hydraulic end
2—high/low-pressure manifold skid;
  21—main pipeline;
    22—main pipeline support;
3—guide rail;
4—intelligent working apparatus;
  41—main body;
42—main-body driving mechanism;
5—working component accommodating apparatus;
6—fracturing device positioning structure.

DETAILED DESCRIPTION

The technical solutions of the embodiments of the present disclosure will be described below in conjunction with the accompanying drawings of the embodiments of the present disclosure. Embodiments described below are merely examples. All other embodiments obtained by a person of ordinary skill in the art based on the embodiments of this application without creative efforts shall fall within the scope of protection of the present disclosure.

The terms "first", "second", and the like used in the present disclosure do not indicate any order, quantity, or importance, but are only intended to distinguish different components. Similarly, terms such as "include" and "comprise" mean that elements or objects preceding the terms include the elements or objects listed after the terms and equivalents thereof, but do not exclude other elements or objects. Similar terms such as "connect" and "connected" are not limited to physical or mechanical connections, but may include electrical connections, whether direct or indirect. The terms "up", "down", "left", "right", and the like are intended merely to indicate a relative position relationship. When an absolute position of a described object changes, the relative position relationship may also change accordingly.

A hydraulic end of a plunger pump is an important component of the plunger pump, which realizes suction of low-pressure liquid and discharge of high-pressure liquid by using an internal structure thereof. During an actual wellsite fracturing operation, high-pressure sand-carrying fluid may erode the hydraulic end and components such as a valve body and a valve seat therein. Therefore, the hydraulic end and other components need to be replaced regularly. At present, replacement of the hydraulic end is manually completed through multi-person collaboration, resulting in a long replacement cycle and high personal operation intensity. Moreover, limited device replacement space and a heavy replacement device easily cause safety accidents such as injuries to personnel. Moreover, space between pipelines in an actual wellsite is limited, which requires improving space utilization of devices and satisfying functional coordination of the devices.

Embodiments of the present disclosure provide a fracturing system. The fracturing system includes: a fracturing device, a high/low-pressure manifold skid, a guide rail, an intelligent working apparatus, and a main-body driving mechanism. The fracturing device has a hydraulic end. The high/low-pressure manifold skid includes a main pipeline extending in a first direction and a main pipeline support for bearing the main pipeline. The fracturing device is located on at least one side of the high/low-pressure manifold skid in a second direction perpendicular to the first direction. The main pipeline is connected to the hydraulic end of the fracturing device. A guide rail is located on the high/low-pressure manifold skid and extends in the first direction. An intelligent working apparatus includes a main body mounted on the guide rail. The main-body driving mechanism is connected to the main body of the intelligent working apparatus and configured to drive the main body of the intelligent working apparatus to move at least along the guide rail. The fracturing system provided in this embodiment facilitates performing, by using the intelligent working apparatus, inspection and maintenance operations on the fracturing device arranged on two sides of the high/low-pressure manifold skid in the second direction, also facilitates inspection and maintenance of the main pipeline, enables the intelligent working apparatus to inspect the wellsite along a direction where the high/low-pressure manifold skid is located, and can avoid occupation of extra space by the arrangement of the guide rail, thereby improving space utilization of the fracturing system.

Figure 2A:
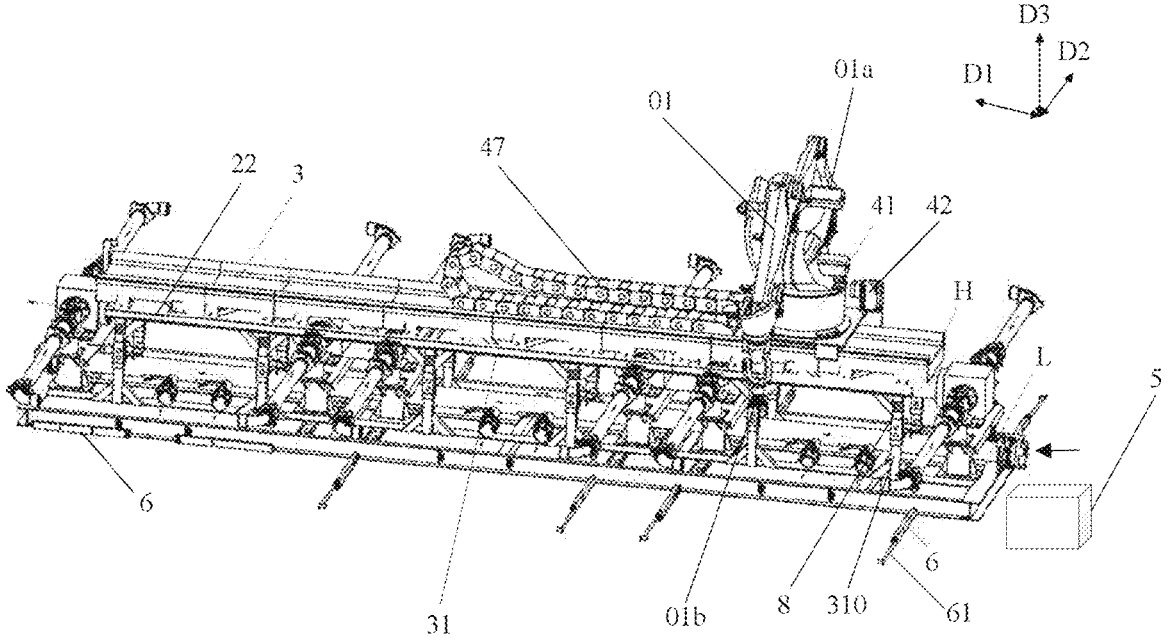
FIG. 2A is an example partial schematic diagram I of a fracturing system including a high/low-pressure manifold skid, a guide rail, and an intelligent working apparatus according to an embodiment of the present disclosure.
Figure 2B:
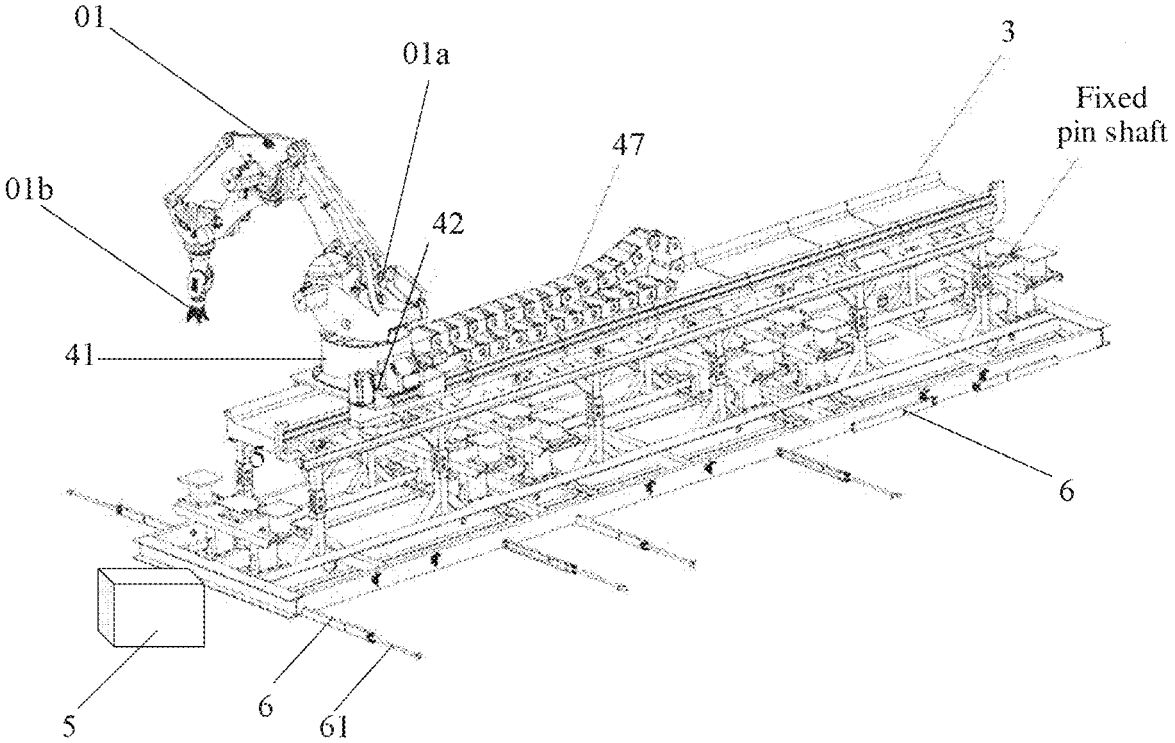
FIG. 2B is an example partial schematic diagram II of a fracturing system including a high/low-pressure manifold skid, a guide rail, and an intelligent working apparatus according to an embodiment of the present disclosure.
Figure 2C:
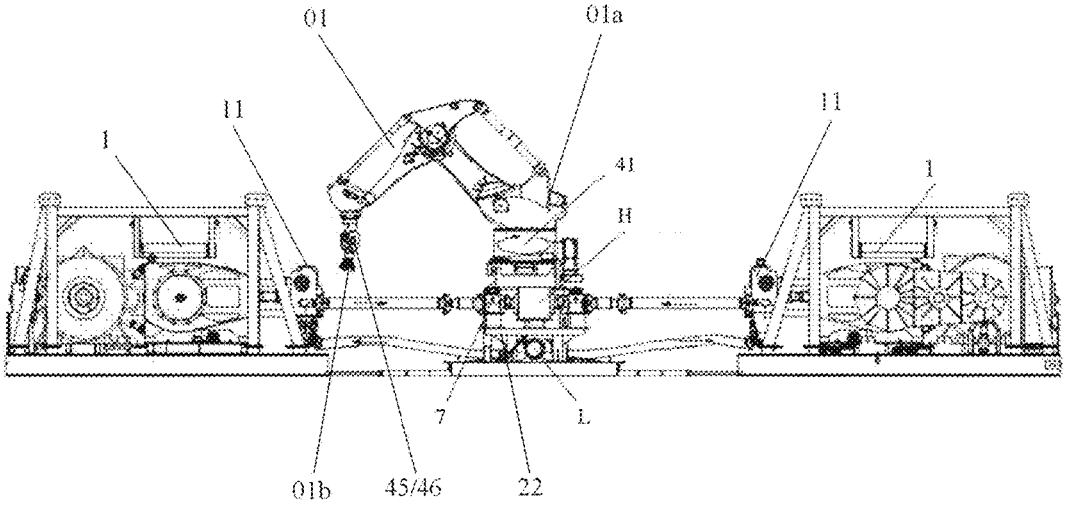
FIG. 2C is an example partial schematic diagram III of a fracturing system including a high/low-pressure manifold skid, a guide rail, and an intelligent working apparatus according to an embodiment of the present disclosure.

FIG. 1 is an example schematic plan view of a fracturing system according to an embodiment of the present disclosure; FIG. 2A is an example partial schematic diagram I of a fracturing system including a high/low-pressure manifold skid, a guide rail, and an intelligent working apparatus according to an embodiment of the present disclosure; FIG. 2B is an example partial schematic diagram II of a fracturing system including a high/low-pressure manifold skid, a guide rail, and an intelligent working apparatus according to an embodiment of the present disclosure; and FIG. 2C is an example partial schematic diagram III of a fracturing system including a high/low-pressure manifold skid, a guide rail, and an intelligent working apparatus according to an embodiment of the present disclosure.

As shown in FIG. 1 and FIG. 2A to FIG. 2C, embodiments of the present disclosure provide a fracturing system 10. The fracturing system 10 includes: a fracturing device 1, a high/low-pressure manifold skid 2, a guide rail 3, an intelligent working apparatus 4, and a main-body driving mechanism 42. The fracturing device 1 has a hydraulic end 11. The high/low-pressure manifold skid 2 includes a main pipeline 21 extending along a first direction D1 and a main pipeline support 22 for bearing the main pipeline 21, the fracturing device 1 is located on at least one side of the high/low-pressure manifold skid 2 in a second direction D2 perpendicular to the first direction D1, and the main pipeline 21 is connected to the hydraulic end 11 of the fracturing device 1. The guide rail 3 is located on the high/low-pressure manifold skid 2 (on a side away from the ground) and extends along the first direction D1. The intelligent working apparatus 4 includes a main body 41 mounted on the guide rail 3. The main-body driving mechanism 42 is connected to the intelligent working apparatus 4 and is configured to drive the intelligent working apparatus 4 to move at least along the guide rail 3.

In an embodiment, the guide rail 3 is disposed on the high/low-pressure manifold skid 2, and the guide rail 3 and the high/low-pressure manifold skid 2 both extend along the first direction D1, so that the guide rail 3 configured to mount the intelligent working apparatus 4 is disposed at a position where the high/low-pressure manifold skid 2 is located.

Since there are many devices in a fracturing wellsite, pipeline connections between the devices are often complicated, and generally there are pipelines between the fracturing device 1 and the high/low-pressure manifold skid 2, which makes it difficult to utilize the space and is not conducive to daily maintenance of the pipelines. In embodiments of the present disclosure, the guide rail 3 and the intelligent working apparatus 4 do not need to design separate placement space for the high/low-pressure manifold skid 2 in the fracturing wellsite. A region where the high/low-pressure manifold skid 2 is located extending along the first direction D1 is a core position of the wellsite, and the fracturing device 1 is located on one side or two sides of the high/low-pressure manifold skid 2 in the second direction D2.

The main pipeline 21 and the hydraulic end 11 of the fracturing device 1 are prone to failures, or parts require regular maintenance or replacement. In embodiments of the present disclosure, the guide rail 3 and the intelligent working apparatus 4 are designed to facilitate the intelligent working apparatus 4 to move along an extension position of the high/low-pressure manifold skid 2, facilitates performing, by using the intelligent working apparatus 4, inspection and maintenance operations on the fracturing device 1 arranged on two sides of the high/low-pressure manifold skid 2 in the second direction D2, also facilitates inspection and maintenance on the main pipeline 21, enables the intelligent working apparatus 4 to inspect the wellsite along a direction where the high/low-pressure manifold skid 2 is located, and can avoid occupation of extra space by the arrangement of the guide rail 3.

In an actual fracturing wellsite, a space between pipelines is limited, it is difficult to set up tracks, and it is difficult to utilize the space. In embodiments of the present disclosure, the design of the guide rail 3 and the intelligent working apparatus 4 can improve space utilization of the fracturing system.

In this embodiment, after being mounted, the intelligent working apparatus can be hoisted and transported together with the high/low-pressure manifold skid without frequent disassembly and assembly.

For example, as shown in FIG. 1 and FIG. 2A to FIG. 2B, the guide rail 3 and the high/low-pressure manifold skid 2 at least partially overlap in a third direction D3 perpendicular to both the first direction D1 and the second direction D2. For example, the guide rail 3 is centrally fixedly mounted directly on the high/low-pressure manifold skid 2 to further avoid occupation of excessive extra space by the arrangement of the guide rail 3.

For example, as shown in FIG. 1, the fracturing system 10 includes a plurality of fracturing devices 1, the plurality of fracturing devices 1 are located on two sides of the guide rail 3 in the second direction D2 and are spaced apart from each other in the first direction D1. Certainly, in other embodiments, the plurality of fracturing devices 1 may alternatively be disposed on one side of the guide rail 3 in the second direction D2. The main-body driving mechanism is configured to drive the intelligent working apparatus 4 to move to a target position on the guide rail 3 to perform an operation on a target apparatus at the target position. For example, the target position includes a position directly facing each of the plurality of fracturing devices 1, and the target apparatus includes each fracturing device 1. Therefore, the intelligent working apparatus 4 may move along the guide rail 3 to sequentially move to the position of each fracturing device 1, and the operations performed on each fracturing device 1 include maintenance and inspection of the fracturing device 1, replacement of parts, and the like.

For example, the target apparatus may also include other structures, such as sub-pipelines arranged along the main pipeline 21, the ground, space of a fracturing wellsite, and the like. Therefore, the intelligent working apparatus 4 may move along the guide rail 3 to perform maintenance and inspection on the main pipeline 21 and sub-pipelines, such as a low-pressure sub-pipeline L1 and a high-pressure sub-pipeline H1, and replacement of parts, such as replacement of valve plugs, telescopic structures, and the like of the main pipeline and the sub-pipelines, thereby improving a degree of automation and efficiency. According to a quantity of the fracturing devices in the fracturing wellsite, guide rails having different lengths and configured to dispose the intelligent working apparatus may be set up.

For example, the intelligent working apparatus 4 is an industrial robot, such as a KUKA robot. A dedicated robot moving track is designed and fixed on the existing manifold skid at the wellsite by using a dedicated mounting support. According to a quantity of the fracturing devices in the wellsite, robot tracks having different lengths may be set up.

For example, the guide rail in this embodiment may be of various styles, including, but not limited to, ball screw tracks, dovetail sliding rails, rack-and-pinion guide rails, load-bearing roller sets+U-groove guide rails.

For example, the main-body driving mechanism 42 is further configured to drive the intelligent working apparatus 4 to rotate on the guide rail 3, and a rotation angle of the rotation is in a range of 0 to 360°, to facilitate the intelligent working apparatus 4 to inspect spaces and devices in all directions around. The inspection herein includes inspection of whether the device is faulty and whether the surrounding environment is safe, such as whether there is a pedestrian and whether there is a fire, to enhance automatic safety monitoring guarantee.

For example, as shown in FIG. 2A to FIG. 2B, the intelligent working apparatus 4 includes a main body 41 mounted on the guide rail 3, and the main-body driving mechanism 42 is connected to the main body 41 of the intelligent working apparatus 4 to drive the main body 41 of the intelligent working apparatus 4 to move at least along the guide rail 3. For example, as shown in FIG. 2A, the fracturing system 10 further includes a cable chain 47, and the cable chain 47 is connected to the main-body driving mechanism 42 and the main body 41 to transfer power and provide power for the intelligent working apparatus 4.

Figure 3A:
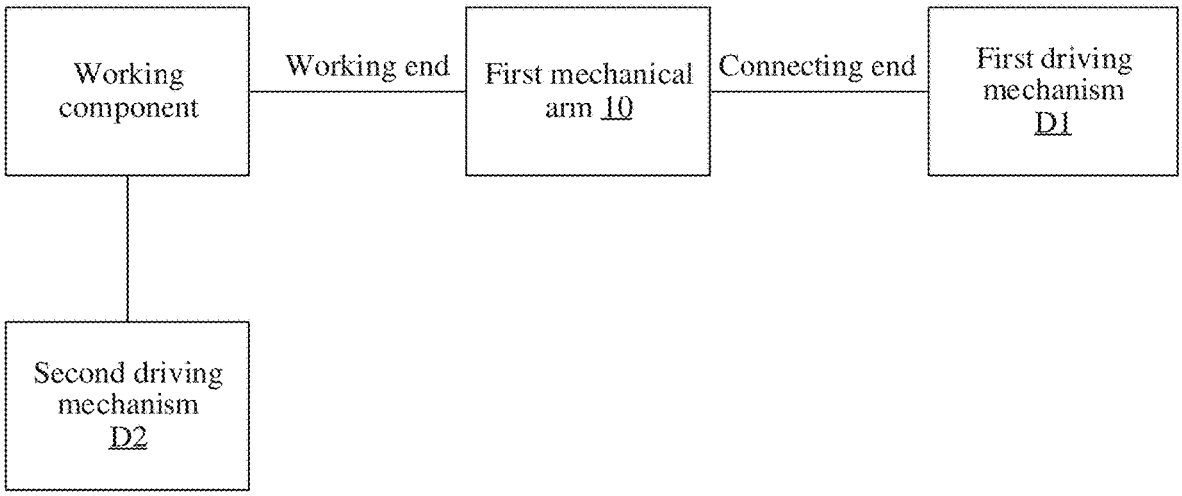
FIG. 3A is an example schematic diagram of a structural relationship between a working component, a first mechanical arm, a first driving mechanism, and a second driving mechanism of a fracturing system according to an embodiment of the present disclosure.

FIG. 3A is an example schematic diagram of a structural relationship between a working component, a first mechanical arm, a first driving mechanism, and a second driving mechanism of a fracturing system according to an embodiment of the present disclosure. For example, referring to FIG. 2A to FIG. 2B and FIG. 3A, the intelligent working apparatus 4 further includes a first mechanical arm 01, a first driving mechanism D1, and a second driving mechanism D2. The first mechanical arm 01 includes a connecting end 01*a* connected to the main body 41 and a working end 01*b* away from the main body 41, the working end 01*b* is configured to be detachably connected to a working component, the working component includes at least one of a rotating component, a pulling component, and a clamping component, and the operation performed includes at least one of a rotating operation, a pulling operation, and a clamping operation. The first driving mechanism D1 is connected to the connecting end 01*a* of the first mechanical arm 01 and is configured to drive the first mechanical arm 01 to move in a three-dimensional space. The second driving mechanism D2 is configured to drive the working component connected to the working end 01*b* to operate, for example, to complete dismounting and mounting of a plurality of functional components. In this way, it takes a shorter time to replace components of the hydraulic end of the plunger pump by using the intelligent working apparatus 4 moving along the guide rail 3, especially when components that are difficult to dismount, such as a valve seat spring sleeve, a valve seat, and a plunger, are replaced, a time-saving and labor-saving effect is obvious, and safety accidents such as a worker's feet being hit by the components or the worker's waists being sprained during manual replacement of the components of the hydraulic end.

Figure 3B:
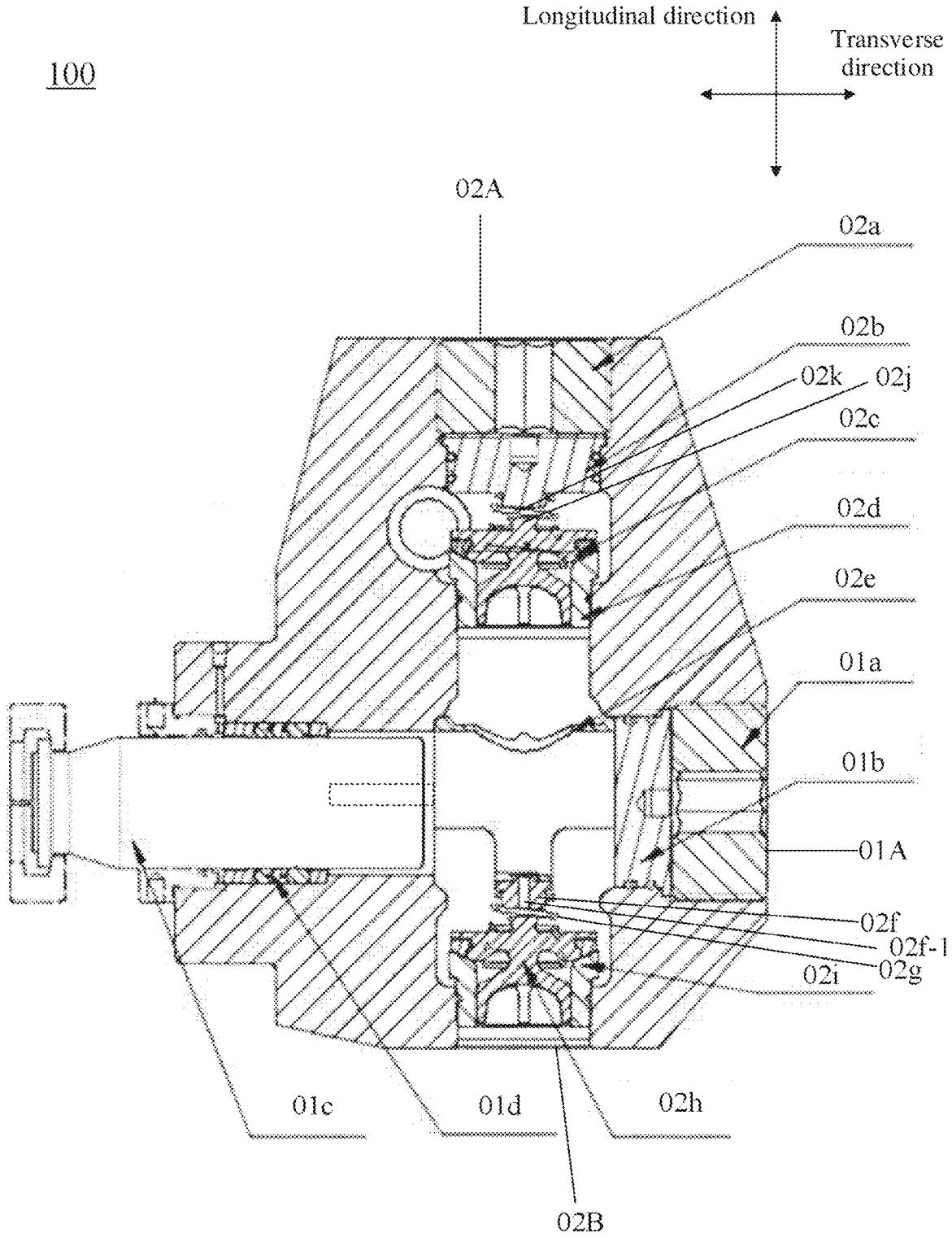
FIG. 3B is an example schematic structural diagram of a plunger pump of a fracturing device of a fracturing system according to an embodiment of the present disclosure.

FIG. 3B is an example schematic structural diagram of a plunger pump of a fracturing device of a fracturing system according to an embodiment of the present disclosure. For example, as shown in FIG. 3B, the plunger pump includes a hydraulic end 100, and the hydraulic end includes a first cavity 01A and a plurality of first functional components located in the first cavity 01A.

Figure 3C:
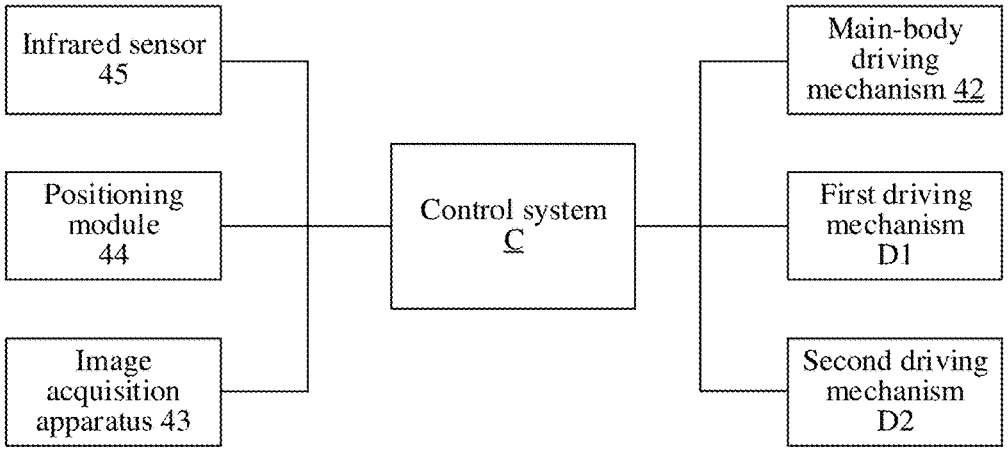
FIG. 3C is an example schematic diagram of a connection relationship between a control system and some working parts of a fracturing system according to an embodiment of the present disclosure.

FIG. 3C is an example schematic diagram of a connection relationship between a control system and some working parts of a fracturing system according to an embodiment of the present disclosure. For example, as shown in FIG. 3C, the fracturing system further includes a control system C. For example, as shown in FIG. 3B, the control system C is further communicatively connected, respectively, to the main-body driving mechanism 42, the first driving mechanism D1, and the second driving mechanism D2. The control system C is configured to control the main-body driving mechanism 42 to drive the intelligent working apparatus 4 to move at least along the guide rail 3 to the target position and drive the intelligent working apparatus 4 to rotate, configured to control the first driving mechanism D1 to drive the first mechanical arm 01 to move to the hydraulic end 11, and configured to control the second driving mechanism D2 to the working component connected to the working end 01*b* to dismount or mount functional components of the hydraulic end 11. Referring to FIG. 3B, the control system C is configured to control the first driving mechanism D1 to drive the first mechanical arm 01 to move in an extension direction of the first cavity 01A and control the first mechanical arm 01 to drive the plurality of working components to enter the first cavity 01A, and configured to control respective matching connections with a plurality of first functional components in the first cavity 01A, to dismount or mount the plurality of first functional components in the first cavity 01A.

For example, the hydraulic end further includes a second cavity 02A and a plurality of second functional components located in the second cavity 02A, and the control system C is further configured to control the first driving mechanism to drive the first mechanical arm 01 to move in an extension direction of the second cavity 02A, control the first mechanical arm 01 to drive the plurality of working components to enter the second cavity 02A, and be respectively in matching connections with a plurality of second functional components in the second cavity 02A, to dismount or mount the plurality of second functional components in the second cavity 02A.

For example, the second driving mechanism D2 may be located at the working end 01*b* of the first mechanical arm 01, including a motor. For example, the second driving mechanism may be detachably connected to the working end 01*b* of the first mechanical arm 01. Before the plunger pump is dismounted or mounted, the second driving mechanism may be manually mounted at the working end 01*b* of the first mechanical arm 01; or the working end 01*b* of the first mechanical arm 01 includes a hollow housing, and the second driving mechanism is located in the housing of the working end 01*b*.

For example, the communication connections of the control system C with the first driving mechanism D1 and the second driving mechanism D2 may be wired connections or wireless connections. For example, the control system may be disposed on the first mechanical arm 01, for example, located in the housing of the working end 01*b*, so as to be electrically connected to the first mechanical arm 01 by using a wire. A wire or circuit board configured to electrically connect the two may be arranged in the housing of the working end 01*b*. A specific manner in which the control system is disposed and manners in which the control system is communicatively connected to the first driving mechanism and the second driving mechanism are not limited in the present disclosure, and may be designed by a person skilled in the art by using common technologies in the art.

Referring to FIG. 3B, for example, the first cavity 01A intersects and is communicated with the second cavity 02A, the first cavity 01A extends along a transverse direction, the second cavity 02A extends along a longitudinal direction, the first cavity 01A has a first end and a second end opposite to each other in the transverse direction, and the second cavity 02A has a first end and a second end opposite to each other in the longitudinal direction. For example, the longitudinal direction is perpendicular to the transverse direction. For example, in an operating state of the plunger pump, the first functional components include a first pressure cap 01*a*, a first gland 01*b*, and a plunger 01*c*. The first pressure cap 01*a* is located at the first end of the first cavity 01A. The plunger 01*c* extends along the transverse direction and is located at the second end of the first cavity 01A. The second functional components include a second pressure cap 02*a*, a second gland 02*b*, a first valve spring seat 02*f*, a first valve spring 02*g*, a first valve body 02*h*, a first valve body seat 02*i*, a valve spring seat sleeve 02*e*, a second valve spring seat 02*j*, a second valve spring 02*k*, a second valve body 02*c*, and a second valve body seat 02*d*. The second pressure cap 02*a* is located at the first end 02A of the second cavity 02A. The valve spring seat sleeve 02*e* is located on one side of the plunger 01*c* in the transverse direction and has a hollow housing. The first valve spring seat 02*f* is detachably connected to the first valve spring 02*g*, and is located on a side of the housing close to the second end 02B of the second cavity 02A in the longitudinal direction. The valve spring seat sleeve 02*e* is located on one side of the plunger 01C in the transverse direction and has a hollow housing clamped at an intersection between the first cavity 01A and the second cavity 02A. The first gland 01*b* is in contact with the valve spring seat sleeve 02*e*. The first gland 01*b* and the first pressure cap 01*a* seal the first end of the first cavity 01A and fix the valve spring seat sleeve 02*e* together with the plunger 01*c* and cavity walls. The housing of the valve spring seat sleeve 02*e* has a right opening e2 facing the first end of the first cavity 01A, a left opening e1 facing the second end of the first cavity 01A, and a lower opening e3 facing the second end of the second cavity 02A. The first valve spring 02*g* sleeves the first valve spring seat 02*f* and is telescopic along the longitudinal direction. The first valve spring seat 02*f* is located on one side of the housing of the valve spring seat sleeve 02*e* having the lower opening e3 and has a through hole 02*j*-1 that passes through the first valve spring seat 02*f* along the longitudinal direction. The through hole 02*j*-1 is communicated with the lower opening e3 of the first valve spring seat 02*f*. The first valve body 02*h* is mounted on the first valve body seat 02*i*. The second valve spring 02*k* sleeves the second valve spring seat 02*j* and is telescopic along the longitudinal direction. The second valve body 02*c* is mounted on the second valve body seat 02*d*. For example, the second valve spring seat 02*j* and the second valve body 02*c* are integrally formed or separately provided; or the second valve spring seat 02*j* and the first pressure cover 02*b* are integrally formed or separately provided. The second gland 02*b* is connected to the second valve spring seat 02*j*. The second pressure cap 02*a* and the second gland 02*b* seal the first end of the second cavity 02A and fix the second valve spring seat 02*j*.

The intelligent working apparatus 4 may be moved along the guide rail 3 to the position of the hydraulic end of the corresponding fracturing device to inspect each fracturing device, including inspecting the hydraulic end of the plunger pump of the fracturing device, so as to determine whether a suction plug of the hydraulic end (pump head) of the plunger pump is blocked, whether a discharge plug is blocked, determine parts that need to be replaced or repaired, and assist maintenance personnel to dismount various structures of the hydraulic end of the plunger pump. For example, the first mechanical arm 01 of the intelligent working apparatus 4 may also serve as a crane to assist in the dismounting and mounting of the various structures of the hydraulic end of the plunger pump. After the dismounting is completed, the intelligent working apparatus 4 may move to a tail end of the guide rail 3, lift and transport a new pump head to a maintenance position, and assist in completing the replacement of the various structures of the hydraulic end of the plunger pump. The intelligent working apparatus 4 may realize automatic dismounting of the suction plug, the discharge plug, and an end cover of the hydraulic end (or pump head) of the plunger pump by quickly replacing different end-actuating tools, assist the personnel in replacing the valve seat, and reduce a workload of the personnel in pump inspection.

For example, the first mechanical arm 01 of the intelligent working apparatus 4 is connected to the functional components to dismount and mount the corresponding components in the first cavity 01A and the second cavity 02A of the hydraulic end of the plunger pump, or the intelligent working apparatus 4 includes a plurality of mechanism arms, the plurality of mechanism arms respectively mount different functional components, and the plurality of mechanism arms collaborate to complete dismounting and mounting of the corresponding components in the first cavity and the second cavity of the hydraulic end of the plunger pump.

Certainly, in some embodiments, the hydraulic end 100 of the plunger pump may alternatively include only the first cavity 01A or only the second cavity 02A. Here, a case where the hydraulic end 100 of the plunger pump includes the first cavity 01A and the second cavity 02A shown in FIG. 3B is taken as an example to introduce an automatic dismounting and mounting system of the plunger pump and a method for automatically dismounting and mounting the hydraulic end 100 of the plunger pump.

For example, as shown in FIG. 2A to FIG. 2B, the fracturing system 10 further includes a working component accommodating apparatus 5, and the working component accommodating apparatus 5 is disposed along the guide rail 3, to facilitate the working end of the robot to reach the working component accommodating apparatus 5. For example, the working component accommodating apparatus 5 is located at least one end of the guide rail 3 in the first direction D1, or one working component accommodating apparatus 5 is disposed along the guide rail 3 at a position corresponding to each fracturing device 1. The working component accommodating apparatus 5 is configured to accommodate the working component on standby. The intelligent working apparatus 4 moves on the guide rail 3 to cause the working end 01*b* of the first mechanical arm 01 to reach the working component accommodating apparatus 5 and connect with the working component.

For example, the working component accommodating apparatus 5 may be connected to the guide rail support 31 to increase a height. The working end thereof can reach the working component accommodating apparatus 5 without requiring a length of a first manipulator of the robot to be very long, which makes it easier for the working end of the robot to reach the working component accommodating apparatus 5. Certainly, the working component accommodating apparatus 5 may not be connected to the guide rail support 31 and be disposed on the ground, which simplifies the structure and rationally utilizes a blank ground space.

For example, the working component accommodating apparatus 5 includes a plurality of accommodating grooves matching a plurality of working components and respectively accommodating the plurality of working components. A connecting end of the working component connected to the working end 01*b* of the first mechanical arm 01 is exposed, and the working end 01*b* of the first mechanical arm 01 may reach the connecting end of the working component and be connected to the working component.

For example, referring to FIG. 1 and FIG. 2A to FIG. 2B, the fracturing system 10 further includes a guide rail support 31, the guide rail support 31 extends along the first direction D1, is connected to the main pipeline support 22, and is located on a side of the main pipeline support 22 away from the ground, the guide rail 3 is mounted on the guide rail support 31, and the guide rail 3 is located on a side of the main pipeline 21 away from the ground. The guide rail support 31 includes a plurality of legs 310. The plurality of legs 310 are mounted on the main pipeline support 22, are quickly positioned by using positioning pin shafts, and are mounted and fastened by using bolts. The main pipeline support 22, the guide rail support 31, and the guide rail 3 cooperate with each other to efficiently and stably dispose the guide rail 3 on the main pipeline 21 without affecting layout of the main pipeline 21.

For example, the fracturing system 10 further includes a conductive cable housing apparatus and a conductive cable. The conductive cable housing apparatus is located on the guide rail 3. The guide rail 3 has a first side facing away from the main pipeline 21 and a second side facing the main pipeline 21 (i.e., the bottom of the guide rail 3) in the third direction D3, the intelligent working apparatus 4 is located on the first side of the guide rail 3, and the conductive cable housing apparatus is located on the second side of the guide rail 3. The conductive cable is located in the conductive cable housing apparatus and is electrically connected to the intelligent working apparatus 4. For example, the conductive cable housing apparatus is a cable tray, a cable rack, or the like. For example, the conductive cable housing apparatus is located in a middle part of the guide rail 3 in the first direction D1 or disposed at a position along the entire length of the guide rail 3 in the first direction D1. For example, the conductive cable housing apparatus is located below the guide rail 3 and is cable tray, and a cable bridge is laid below the guide rail 3 to ensure that wires are all arranged below the guide rail 3 and on the main pipeline 21 without occupying other space, thereby improving space utilization and prolonging the service life of the cables.

For example, as shown in FIG. 2A, the fracturing system 10 further includes a shock-absorbing structure 8, and the shock-absorbing structure 8 is disposed on the guide rail support 31 and is configured to reduce vibration caused to the guide rail 3 during the operation of the fracturing device 1. For example, the shock-absorbing structure 8 is located on at least one leg 310 of the guide rail support 31. For example, the shock-absorbing structure 8 is disposed on each leg 310 to reduce an influence of vibration generated by the movement of the intelligent working apparatus 4 on the guide rail 3 and during the operation on stability of the guide rail support 31, the main pipeline support 22, and the main pipeline 21, so as to enhance stability of an overall structure including the main pipeline support 22, the main pipeline 21, the guide rail support 31, the guide rail 3, and the intelligent working apparatus 4. Moreover, the shock-absorbing structure 8 can reduce an influence of vibration of the fracturing device on the intelligent working apparatus 4 during the fracturing operation. For example, the shock-absorbing structure 8 is a rubber shock absorbing pad, a wire rope vibration isolator, or the like. A specific type of the shock-absorbing structure is not limited in this embodiment of the present disclosure.

For example, as shown in FIG. 2C, an infrared sensor 45 is disposed at the working end 01*b* of the first mechanical arm 01, is exposed to a surface of the working end 01*b*, and is connected to the control system C in a signal manner, and the infrared sensor 45 is configured to acquire image information of a surrounding environment during the movement of the intelligent working apparatus 4 on the guide rail 3, acquire image information of the target apparatus during the operation on the target apparatus at the target position, and transmit the image information to the control system C. The control system C is configured to determine the target position according to the image information of the surrounding environment and the image information of the target apparatus, and the target position includes a position of the target apparatus where a failure occurs. An operator determines an abnormal situation by using the image information and takes next action accurately and promptly.

For example, the image acquisition apparatus includes a high-definition camera, which acquires the image information of the surrounding environment by using a principle such as taking pictures, scanning QR codes, or identifying radio frequency identification (RFID). For example, transported consumables may be recorded by using a visual recognition system equipped with a camera. For example, the robot may determine mounting positions of consumables such as the replaced valve body and valve seat, record data information of each consumable, and transmit the information to a memory to facilitate big data statistics and plunger pump maintenance information query.

For example, as shown in FIG. 3C, the intelligent working apparatus 4 includes a positioning module 44, the positioning module 44 is connected to the control system C in a signal manner and is configured to transmit position information of the intelligent working apparatus 4 to the control system C. The control system C is configured to determine, according to the position information, whether the target position is reached.

For example, the intelligent working apparatus 4 is configured to move according to a patrol route. For example, the intelligent working apparatus 4 may move along a set patrol route under remote control of the personnel. The positioning module 44 is configured to record route position information of the intelligent working apparatus 4 in real time during the movement of the intelligent working apparatus 4 and send the route position information to the control system C, the control system C is further configured to receive and record the route position information, the route position information forms the patrol route, and the control system C controls, according to the patrol route, the intelligent working apparatus to move based on the patrol route; or the control system C includes position information in the patrol route and is configured to control, according to the position information in the patrol route, the intelligent working apparatus to move based on the patrol route, the positioning module 44 is configured to acquire real-time route position information of the intelligent working apparatus during the movement according to the patrol route and send the real-time route position information to the control system C, and the control system C determines whether the route position information is correct.

For example, as shown in FIG. 3C, the intelligent working apparatus 4 includes an infrared sensor 45, the infrared sensor 45 is configured to perform infrared sensing on the surrounding environment during the movement of the intelligent working apparatus 4 and send an infrared sensing result to the control system C, and the control system C is configured to control a position of the intelligent working apparatus 4 according to the infrared sensing result. For example, as shown in FIG. 2C, the infrared sensor 45 is disposed at the working end 01*b* of the first mechanical arm 01, to perform infrared sensing on the surrounding environment as the working end 01*b* moves, thereby achieving a large detection range. For example, the infrared sensor 45 detects a pedestrian, the control system includes a first judgment module, and the first judgment module makes a judgment based on information transmitted by the infrared sensor 45, thereby controlling an infrared alarm to send out a first alarm signal to warn the pedestrian to avoid an operating component such as a manipulator of the intelligent working apparatus.

For example, as shown in FIG. 2C, the intelligent working apparatus 4 includes a flame sensor 46 configured to perform temperature sensing on the surrounding environment during the movement of the intelligent working apparatus 4 and send a temperature sensing result to the control system C, and the control system C is configured to determine, according to the temperature sensing result, whether a flame is required. For example, the flame sensor 46 is disposed at the working end 01*b* of the first mechanical arm 01, to facilitate the flame sensor 46 to perform temperature sensing on the surrounding environment as the working end 01*b* moves, thereby achieving a large detection range. The flame sensor 46 is, for example, a temperature sensor. For example, the flame sensor 46 detects a high-temperature signal, the control system includes a second judgment module, and the second judgment module makes a judgment based on information transmitted by the flame sensor 46, thereby controlling a high-temperature alarm to send out a second alarm signal to issue a fire warning. At the same time, whether there is a flame may be determined by combining the image information.

Figure 3D:
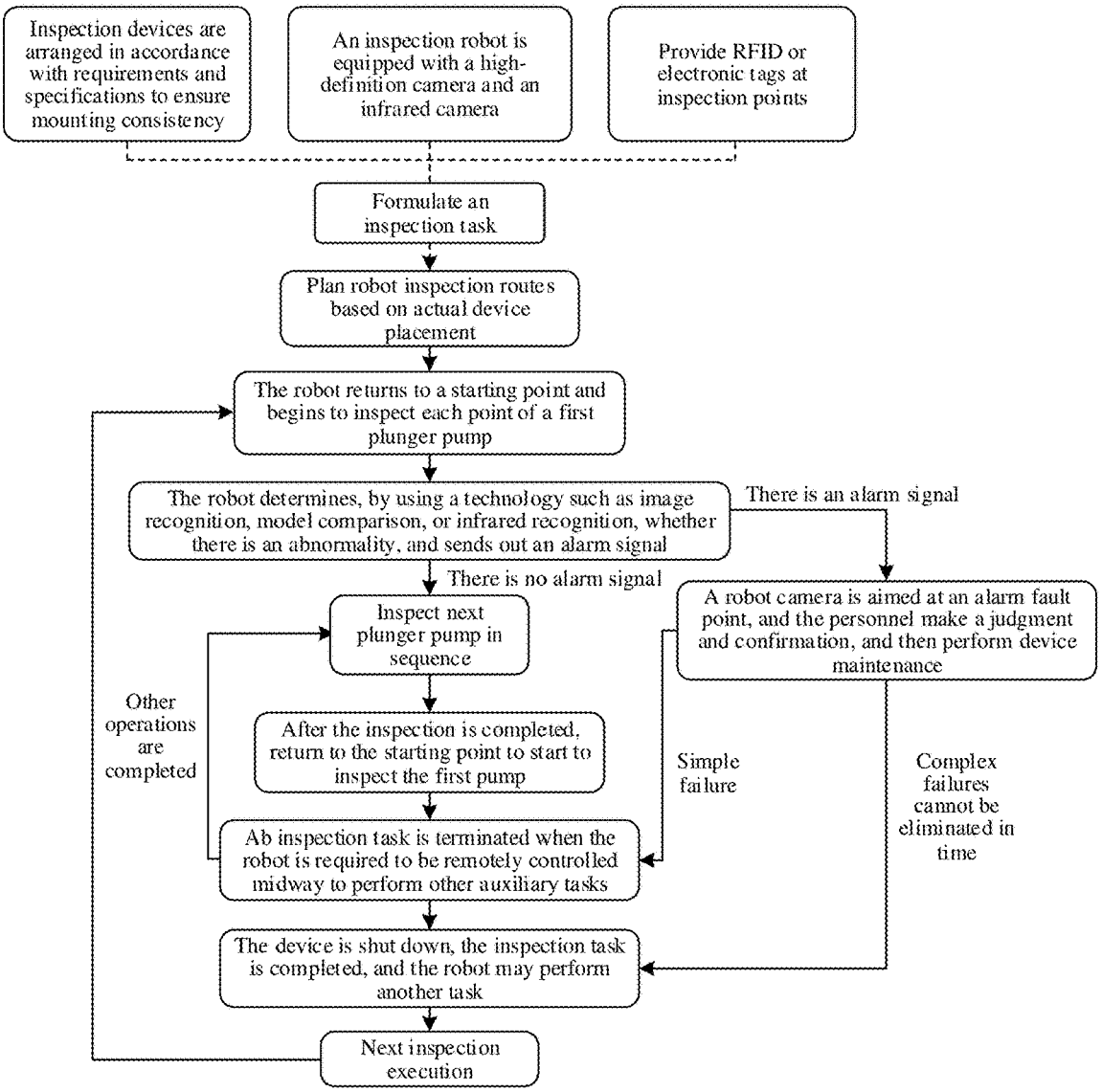
FIG. 3D is an example schematic diagram of inspection logic of an intelligent working apparatus of a fracturing system according to an embodiment of the present disclosure.

For example, the intelligent working apparatus performs inspection according to a diagram of inspection logic shown in FIG. 3D. An inspection route and various steps are as described above.

In this embodiment, the control system C may include a processor and a memory. The processor may be, but is not limited to, a central processing unit, a microcontroller unit, a microprocessor, or a programmable logic device.

It may be understood that the memory may be a volatile memory or a nonvolatile memory, or may include both the volatile memory and the nonvolatile memory. The nonvolatile memory may be a read-only memory (ROM), a programmable ROM (PROM), an erasable PROM (EPROM), an electrically EPROM (EEPROM), or a flash memory. The volatile memory may be a random access memory (RAM) and is used as an external cache. By way of example but not limitation, many forms of RAMs may be used, for example, a static RAM (SRAM), a dynamic RAM (DRAM), a synchronous DRAM (SDRAM), a double data rate SDRAM (DDR SDRAM), an enhanced SDRAM (ESDRAM), a synchlink DRAM (SLDRAM), and a direct rambus RAM (DR RAM). The memory aims to include, but is not limited to, these and any other suitable types of memories.

For example, the memory stores the following elements: an executable module or a data structure, or a subset or extension set thereof, such as an operating system and an application, and corresponding execution modules such as an evaluation module and a judgment module. The operating system includes various system programs, such as a framework layer, a core library layer, and a driver layer, for implementing various basic services and processing hardware-based tasks. The application includes various applications, such as a media player and a browser, for implementing various application services. The programs implementing the method provided in the embodiments of the present disclosure may be included in the application.

For example, as shown in FIG. 2A to FIG. 2B, the fracturing system 10 further includes a fracturing device positioning structure 6, the fracturing device positioning structure 6 is detachably connected to the main pipeline support 22 and at least partially protrudes beyond the main pipeline support 22 from the main pipeline support 22 towards the fracturing device 1, and a position of the positioning structure on the main pipeline support 22 along the first direction D1 is adjustable. Therefore, the position of the fracturing device 1 in the first direction D1 and the second direction D2 relative to the main pipeline 21 is adjustably determined. The positioning structure 6 functions as a positioning scale.

For example, a plurality of fracturing devices 1 and a plurality of positioning structures 6 (positioning scales) are in one-to-one correspondence, are spaced apart from each other by a preset distance, and are aligned.

Figure 4:
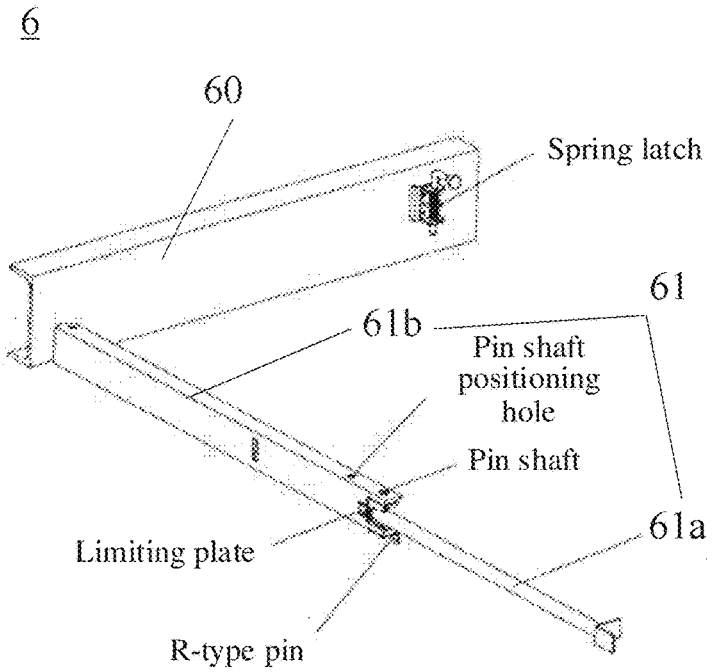
FIG. 4 is an example schematic structural diagram of a fracturing device positioning structure of a fracturing system according to an embodiment of the present disclosure.

FIG. 4 is an example schematic structural diagram of a fracturing device positioning structure of a fracturing system according to an embodiment of the present disclosure. Referring to FIG. 2B and FIG. 4, for example, the fracturing device positioning structure 6 has an adjustable portion 61, and the fracturing device positioning structure 6 is configured to operate in one of an unfolded state and a folded state. In the unfolded state, the adjustable portion 61 extends along the second direction D2 and protrudes from the main pipeline support 22 towards the fracturing device 1. A length of the adjustable portion 61 along the second direction D2 is reduced to convert the high/low-pressure manifold skid 2 into the folded state. In the folded state, at least part of the fracturing device positioning structure 6 is received in and fits the main pipeline support 22, that is, does not protrude from the main pipeline support 22. For example, as shown in FIG. 2B, for example, the adjustable portion 61 rotates along a pin shaft and is folded, and in the folded state, the fracturing device positioning structure 6 fits a side surface of the main pipeline support 22. For example, the fracturing device positioning structure 6 includes a main-body portion 60 and the adjustable portion 61 movably connected to the main-body portion 60. The adjustable portion 61 includes a first portion 61*a* and a second portion 61*b*, and the first portion 61*a* is movably connected to the second portion 61*b*. For example, the first portion 61*a* is movably connected to the second portion 61*b* by using a pin (such as an R-type pin). For example, a limiting plate is provided at an end of the first portion 61*a* close to the second portion 61*b* to limit a position of the first portion 61*a*. In the unfolded state, the first portion 61*a* and the second portion 61*b* both extend along the second direction D2 and protrude from the adjustable portion 61. The first portion 61*a* may rotate along the pin shaft and be folded, and the second portion 61*b* may be folded and fit the main portion 60, to convert into the folded state. The main-body portion 60 is fixed to the side surface of the main pipeline support 22, so that in the folded state, the fracturing device positioning structure 6 fits the side surface of the main pipeline support 22. In this way, when the fracturing device is positioned by using the fracturing device positioning structure 6, the fracturing device positioning structure 6 is unfolded to be in the unfolded state, so as to set the position of each fracturing device 1 in a manner of being aligned with the position of the fracturing device positioning structure 6. After the fracturing device 1 is mounted at the corresponding position, the fracturing device positioning structure 6 is folded to the folded state, which does not occupy space and prevents damage to the fracturing device positioning structure 6. For example, the positions of the plurality of fracturing device positioning structures 6 may be moved along the first direction D1 to set the positions of the fracturing devices as required.

Certainly, the fracturing device positioning structure is not limited to being folded on the side surface of the main pipeline support. For example, the fracturing device positioning structure may alternatively be folded below the main pipeline support (a side of the main pipeline support 22 away from the guide rail 3 in the third direction D3), provided that the fracturing device positioning structure can be hidden and received in the folded state.

Figure 5:
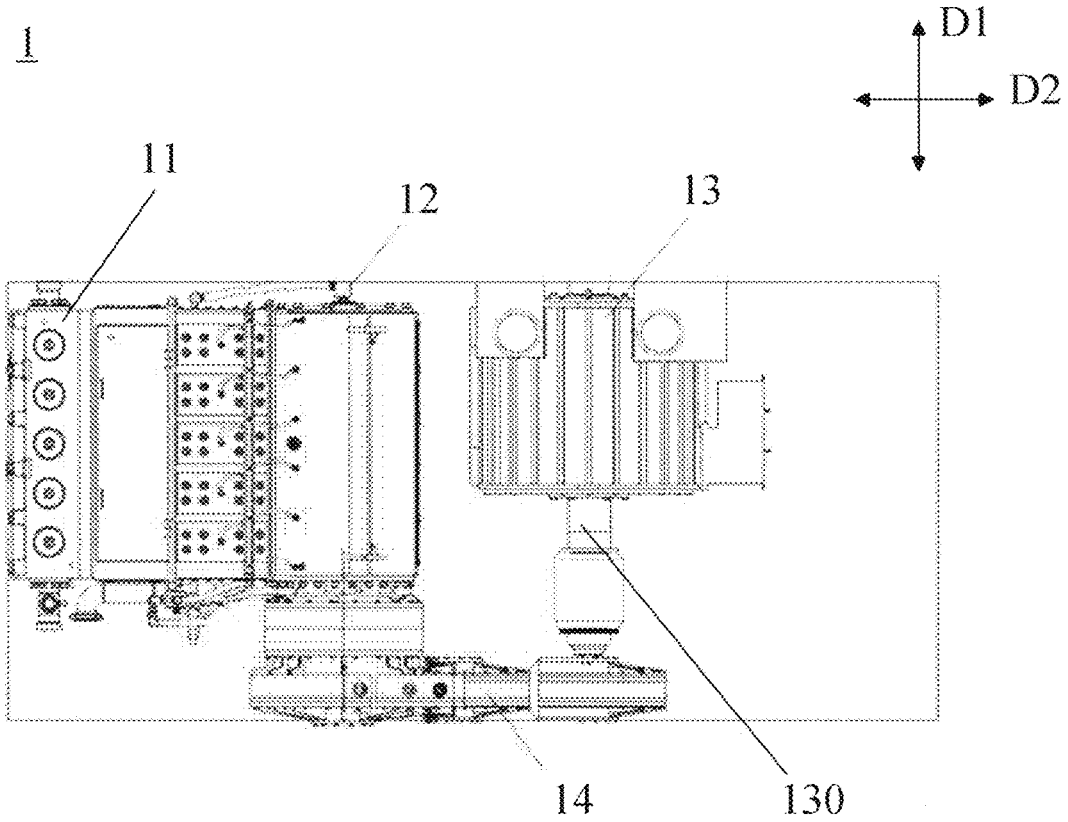
FIG. 5 is an example schematic structural diagram of a fracturing device of a fracturing system including a motor and a reduction gearbox according to an embodiment of the present disclosure.

FIG. 5 is an example schematic structural diagram of a fracturing device of a fracturing system including a motor and a reduction gearbox according to an embodiment of the present disclosure. For example, as shown in FIG. 5, the fracturing device 1 includes a fracturing apparatus, the fracturing apparatus includes the hydraulic end 11 and a power end connected to the hydraulic end 11, and the fracturing device 1 further includes a motor 13 and a reduction gearbox 14. The motor 13 is connected to the power end by using the reduction gearbox 14, the motor 13 and the fracturing apparatus are located on a same side of the reduction gearbox 14, and the motor 13 and the fracturing apparatus are arranged in a direction perpendicular to an extension direction of a motor shaft of the motor 13.

For example, as shown in FIG. 1 and FIG. 5, the motor 13 and the fracturing apparatus are located on the same side of the reduction gearbox 14 in the first direction D1 and are arranged along the second direction D2, and the motor shaft 130 of the motor 13 extends along the first direction D1. The fracturing system 10 includes a plurality of fracturing devices 1, the plurality of fracturing devices 1 are located on at least one side of the main pipeline 21 in the second direction D2 and are spaced apart from each other along the first direction D1 to reduce space occupied by each fracturing device 1 in the first direction D1, that is, in an arrangement direction of the plurality of fracturing devices 1, so as to improve space utilization of the fracturing wellsite.

For example, the hydraulic end 11 has an inlet and an outlet, and the main pipeline 21 includes a low-pressure main pipeline L and a high-pressure main pipeline H. The low-pressure main pipeline L and a high-pressure main pipeline H both extend along the first direction D1 and are arranged in the third direction D3. For example, an orthographic projection of the low-pressure main pipeline L on the ground and an orthographic projection of the high-pressure main pipeline H on the ground at least partially overlap. The low-pressure main pipeline L is configured to provide low-pressure liquid for the hydraulic end 11. The high-pressure main pipeline H is configured to receive high-pressure liquid outputted by the hydraulic end 11. For each fracturing device 1, in the second direction D2, the hydraulic end 11 is located on a side of the power end close to the main pipeline 21. The fracturing system 10 further includes a sub-pipeline corresponding to each fracturing device 1, and the sub-pipeline is located between the guide rail 3 and the main pipeline support 22, to facilitate a connection with the sub-pipeline and reduce complexity of the pipeline.

For example, as shown in FIG. 1, the sub-pipeline includes a low-pressure sub-pipeline L1 and a high-pressure sub-pipeline H1. The low-pressure sub-pipeline L1 is connected to the low-pressure main pipeline L and the inlet of the hydraulic end 11 of the corresponding fracturing device 1. The high-pressure sub-pipeline H1 is connected to the high-pressure main pipeline H and the outlet of the hydraulic end 11 of the corresponding fracturing device 1. At least one of the low-pressure sub-pipeline L1 and the high-pressure sub-pipeline H1 includes a telescopic pipeline structure P, and the telescopic pipeline structure P includes a telescopic pipeline P1 and a flexible high-pressure hose P2. The telescopic pipeline P1 and the high-pressure hose P2 both extend along the second direction D2 and are communicated with each other, a first end of the high-pressure hose P2 is connected to the hydraulic end 11, a second end of the high-pressure hose P2 is connected to the telescopic pipeline P1, and a length of the telescopic pipeline P1 in the second direction D2 is adjustable. Generally, the high/low-pressure manifold skid and the hydraulic end are connected by using a rigid pipe, and complex pipelines are laid between the hydraulic end and the high/low-pressure manifold skid, which makes space utilization difficult and is not conducive to daily maintenance of the pipelines. However, by use of the solution of combining the telescopic pipe P1 and the flexible high-pressure hose P2 provided in this embodiment of the present disclosure, a single pipeline can be used to greatly simplify the structure of the pipeline, and the length of the pipeline can be conveniently adjusted.

For example, each low-pressure sub-pipeline L1 and each high-pressure sub-pipeline H1 include a telescopic pipeline structure P, an upper limit of liquid pressure that the high-pressure hose P2 of the low-pressure sub-pipeline L1 can withstand is less than or equal to an upper limit of liquid pressure that the high-pressure hose P2 of the high-pressure sub-pipeline H1 can withstand, so that the high-pressure sub-pipeline and the low-pressure sub-pipeline can match the liquid pressure respectively conveyed.

For example, the upper limit of the pressure that the high-pressure hose can withstand is greater than or equal to 150 Mpa, to meet a requirement for delivering high-pressure fracturing fluid. Further, for example, the upper limit of the pressure that the high-pressure hose can withstand ranges from 50 Mpa to 200 Mpa, which makes it easy to select an appropriate pressure value and reduces a manufacturing requirement for the high-pressure hose. Certainly, the range of the pressure that the high-pressure hose can withstand is not limited in this embodiment of the present disclosure.

Figure 6:
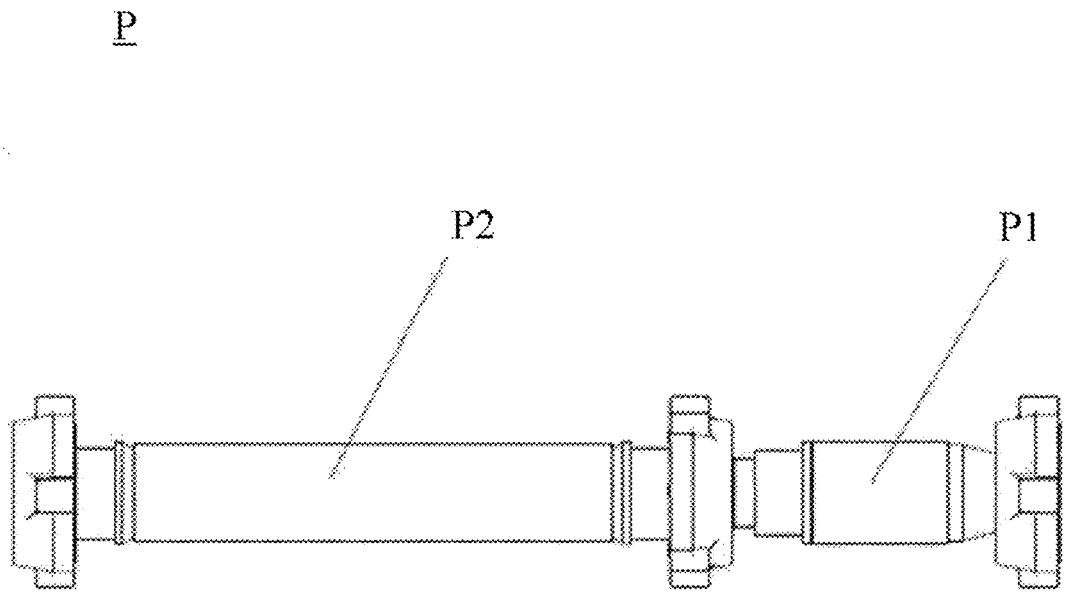
FIG. 6 is an example schematic structural diagram of a telescopic pipeline structure P of a fracturing system according to an embodiment of the present disclosure.

For example, as shown in FIG. 1 and FIG. 6, in the second direction D2, the high-pressure hose P2 is located on a side of the telescopic pipeline P1 close to the hydraulic end 11 of the fracturing device 1. Since the high-pressure hose P2 has higher pressure resistance, the high-pressure hose P2 is disposed on the side of the telescopic pipe P1 close to the hydraulic end 11 of the fracturing device 1, so that the high-pressure hose P2 can first receive the high-pressure fracturing fluid (for example, a solid-liquid mixture) inputted from the hydraulic end 11 of the fracturing device 1, to reduce an impact of the high-pressure liquid entering the end of the pipeline close to the hydraulic end from the hydraulic end 11 on the telescopic pipe P1. Therefore, an overall structure combining the high-pressure hose P2 and the retractable pipe P1 can achieve an adjustable pipeline length and also ensure stability of the pipeline in withstanding the high-pressure fracturing fluid.

For example, for each pipeline including the telescopic pipeline structure P, a length of the high-pressure hose P2 in the second direction D2 is greater than a minimum length of the telescopic pipeline P1 in the second direction D2. For example, the length of the high-pressure hose P2 in the second direction D2 is greater than a maximum length of the telescopic pipe P1 in the second direction D2 after extension, which helps fully utilize the high-pressure hose to enhance the high-pressure resistance of the pipeline and prolong the service life of the pipeline.

For example, in the fracturing system 10, the low-pressure sub-pipeline L1 and/or the high-pressure sub-pipeline H1 including the telescopic pipeline structure P are/is a single pipeline. Herein, the "single pipeline" means that there is only one pipeline as shown in the figure, rather than a complex pipeline structure formed by connecting a plurality of branch pipelines.

The above descriptions are merely exemplary embodiments of the present disclosure and are not intended to limit the protection scope of the present disclosure. The protection scope of the present disclosure is determined according to the scope defined in the claims.

What is claimed is:

1. A fracturing system, comprising:

a fracturing device having a hydraulic end;

a high/low-pressure manifold skid comprising a main pipeline extending along a first direction and a main pipeline support for bearing the main pipeline, wherein the fracturing device is located on at least one side of the high/low-pressure manifold skid in a second direction perpendicular to the first direction, and the main pipeline is connected to the hydraulic end of the fracturing device;

a guide rail located on the high/low-pressure manifold skid and extending along the first direction;

an intelligent working apparatus comprising a main body mounted on the guide rail; and a main-body driving mechanism connected to the main body of the intelligent working apparatus and configured to drive the main body of the intelligent working apparatus to move at least along the guide rail.

2. The fracturing system according to claim 1, wherein the guide rail and the high/low-pressure manifold skid at least partially overlap in a third direction perpendicular to both the first direction and the second direction.

3. The fracturing system according to claim 1, wherein:

the fracturing system comprises a plurality of fracturing devices located on at least one side of the guide rail in the second direction and spaced apart from each other in the first direction;

the main-body driving mechanism is configured to drive the intelligent working apparatus to move to a target position on the guide rail to perform an operation on a target apparatus at the target position;

the target position comprises a position directly facing each of the plurality of fracturing devices; and the target apparatus comprises the each fracturing device.

4. The fracturing system according to claim 3, wherein:

the main-body driving mechanism is further configured to drive the intelligent working apparatus to rotate on the guide rail; and a rotation angle of the rotation is in a range of 0 to 360°.

5. The fracturing system according to claim 3, wherein:

the hydraulic end has an inlet and an outlet;

the main pipeline comprises a low-pressure main pipeline and a high-pressure main pipeline, both extending along the first direction and being arranged in a third direction;

the low-pressure main pipeline is configured to provide low-pressure liquid for the hydraulic end;

the high-pressure main pipeline is configured to receive high-pressure liquid outputted by the hydraulic end;

for each of the fracturing devices, in the second direction, the hydraulic end is located on a side of a power end close to the main pipeline; and the fracturing system further comprises a sub-pipeline corresponding to the each fracturing device and located between the guide rail and the main pipeline support.

6. The fracturing system according to claim 5, wherein the sub-pipeline comprises:

a low-pressure sub-pipeline connected to the low-pressure main pipeline and the inlet of the hydraulic end of the corresponding fracturing device; and a high-pressure sub-pipeline connected to the high-pressure main pipeline and the outlet of the hydraulic end of the corresponding fracturing device;

wherein:

at least one of the low-pressure sub-pipeline and the high-pressure sub-pipeline comprises a telescopic pipeline structure comprising a telescopic pipeline and a flexible high-pressure hose, both extending along the second direction and being communicated with each other;

a first end of the flexible high-pressure hose is connected to the hydraulic end;

a second end of the flexible high-pressure hose is connected to the telescopic pipeline; and a length of the telescopic pipeline in the second direction is adjustable.

7. The fracturing system according to claim 3, wherein the intelligent working apparatus further comprises:

a first mechanical arm comprising a connecting end connected to the main body and a working end away from the main body, wherein the working end is configured to be detachably connected to a working component comprising at least one of a rotating component, a pulling component, and a clamping component, and the operation performed comprises at least one of a rotating operation, a pulling operation, and a clamping operation;

a first driving mechanism connected to the connecting end of the first mechanical arm and configured to drive the first mechanical arm to move in a three-dimensional space; and a second driving mechanism configured to drive the working component connected to the working end to operate.

8. The fracturing system according to claim 7, further comprising:

a working component accommodating apparatus, disposed along the guide rail, connected to a guide rail support, and configured to accommodate the working component on standby, wherein the intelligent working apparatus is configured to move on the guide rail to cause the working end of the first mechanical arm to reach the working component accommodating apparatus and connect with the working component.

9. The fracturing system according to claim 7, further comprising:

a control system communicatively connected, respectively, to the main-body driving mechanism, the first driving mechanism, and the second driving mechanism, wherein the control system is configured to control the main-body driving mechanism to drive the intelligent working apparatus to move at least along the guide rail to the target position and drive the intelligent working apparatus to rotate, configured to control the first driving mechanism to drive the first mechanical arm to move to the hydraulic end, and configured to control the second driving mechanism to drive the working component connected to the working end to dismount or mount functional components of the hydraulic end.

10. The fracturing system according to claim 9, wherein the intelligent working apparatus comprises:

an infrared sensor configured to perform infrared sensing on a surrounding environment during a movement of the intelligent working apparatus and send an infrared sensing result to the control system, wherein the control system is configured to control a position of the intelligent working apparatus according to the infrared sensing result.

11. The fracturing system according to claim 9, wherein the intelligent working apparatus comprises:

a flame sensor configured to perform temperature sensing on a surrounding environment during a movement of the intelligent working apparatus and send a temperature sensing result to the control system, wherein the control system is configured to determine, according to the temperature sensing result, whether a flame is required.

12. The fracturing system according to claim 9, wherein the intelligent working apparatus comprises:

an image acquisition apparatus connected to the control system in a signal manner and configured to acquire image information of a surrounding environment during a movement of the intelligent working apparatus on the guide rail, acquire image information of the target apparatus during a movement operation on the target apparatus at the target position, and transmit the image information to the control system, wherein: the control system is configured to determine the target position according to the image information of the surrounding environment and the image information of the target apparatus, and the target position comprises a position of the target apparatus where a failure occurs.

13. The fracturing system according to claim 12, wherein the intelligent working apparatus comprises:

a positioning module connected to the control system in a signal manner and configured to transmit position information of the intelligent working apparatus to the control system, wherein the control system is configured to determine, according to the position information, whether the target position is reached.

14. The fracturing system according to claim 13, wherein:

the intelligent working apparatus is configured to move according to a patrol route;

the positioning module is configured to record route position information of the intelligent working apparatus in real time during the movement of the intelligent working apparatus and send the route position information to the control system, the control system is further configured to receive and record the route position information forming the patrol route, and the control system is further configured to control, according to the patrol route, the intelligent working apparatus to move based on the patrol route; or the control system comprises position information in the patrol route and is configured to control, according to the position information in the patrol route, the intelligent working apparatus to move based on the patrol route, the positioning module is configured to acquire real-time route position information of the intelligent working apparatus during the movement according to the patrol route and send the real-time route position information to the control system, and the control system is further configured to determine whether the route position information is correct.

15. The fracturing system according to claim 1, further comprising:

a guide rail support, extending along the first direction, connected to the main pipeline support, and located on a side of the main pipeline support away from ground, wherein the guide rail is mounted on the guide rail support and located on a side of the main pipeline away from the ground.

16. The fracturing system according to claim 15, further comprising:

a shock-absorbing structure disposed on the guide rail support and configured to reduce vibration caused to the guide rail during an operation of the fracturing device.

17. The fracturing system according to claim 1, further comprising:

a conductive cable housing apparatus located on the guide rail, wherein:

the guide rail has a first side facing away from the main pipeline and a second side facing the main pipeline in a third direction;

the intelligent working apparatus is located on the first side of the guide rail;

the conductive cable housing apparatus is located on the second side of the guide rail; and a conductive cable is located in the conductive cable housing apparatus and electrically connected to the intelligent working apparatus.

18. The fracturing system according to claim 1, further comprising:

a fracturing device positioning structure detachably connected to the main pipeline support and at least partially protruding beyond the main pipeline support from the main pipeline support towards the fracturing device, wherein a position of the positioning structure on the main pipeline support along the first direction is adjustable.

19. The fracturing system according to claim 18, wherein the fracturing device positioning structure has an adjustable portion and is configured to operate in one of an unfolded state and a folded state, wherein:

in the unfolded state, the adjustable portion extends along the second direction and protrudes from the main pipeline support towards the fracturing device;

a length of the adjustable portion along the second direction is reduced to convert the high/low-pressure manifold skid into the folded state; and in the folded state, at least part of the fracturing device positioning structure is received so as not to protrude from the main pipeline support in the second direction.

20. The fracturing system according to claim 1, wherein the fracturing device further comprises:

a fracturing apparatus comprising the hydraulic end and a power end connected to the hydraulic end;

a motor; and a reduction gearbox, wherein:

the motor is connected to the power end by using the reduction gearbox;

the motor and the fracturing apparatus are located on a same side of the reduction gearbox; and the motor and the fracturing apparatus are arranged in a direction perpendicular to an extension direction of a motor shaft of the motor.

* * * * *